US009333417B2

(12) United States Patent
Harris

(10) Patent No.: US 9,333,417 B2
(45) Date of Patent: May 10, 2016

(54) TILE GAME AND METHOD OF GAME PLAY

(71) Applicant: Paul Gregory Harris, Baltimore, MD (US)

(72) Inventor: Paul Gregory Harris, Baltimore, MD (US)

( * ) Notice: Subject to any disclaimer, the term of this patent is extended or adjusted under 35 U.S.C. 154(b) by 0 days.

(21) Appl. No.: 13/672,816

(22) Filed: Nov. 9, 2012

(65) Prior Publication Data

US 2014/0131949 A1 May 15, 2014

(51) Int. Cl.
*A63F 9/20* (2006.01)

(52) U.S. Cl.
CPC ..... *A63F 9/20* (2013.01)

(58) Field of Classification Search
CPC ..... A63B 67/06; A63F 1/00; A63F 9/20
USPC ..... 273/292, 293, 148 R
See application file for complete search history.

(56) References Cited

U.S. PATENT DOCUMENTS

| | | | | | |
|---|---|---|---|---|---|
| 4,357,018 | A * | 11/1982 | Calvert | 273/261 | |
| 4,776,597 | A * | 10/1988 | Rudell | A63F 3/0423 273/241 | |
| 5,048,840 | A * | 9/1991 | Johnson, Jr. | 273/241 | |
| 5,108,109 | A * | 4/1992 | Leban | 273/242 | |
| 7,077,400 | B2 * | 7/2006 | Kenney | 273/242 | |
| 8,215,642 | B2 * | 7/2012 | Macura et al. | 273/309 | |

* cited by examiner

*Primary Examiner* — Michael Dennis
(74) *Attorney, Agent, or Firm* — Ober, Kaler, Grimes & Shriver; Royal W. Craig

(57) ABSTRACT

A cooperative tile game played on a surface and having bifurcated tiles formed of conjoined hexagons each having an indicia of value. Play is initiated by selecting and placing one or more tiles on the surface in a three-tile triangular initial configuration. Players first exchange tiles from their hand with those in the initial configuration to achieve a predetermined set of tiles in the initial configuration. Subsequent rounds begin with a tile from the previous round. During play tiles are placed in turn such that at least one edge of a hexagonal portions is adjacent to an edge of a hexagonal portion of a previously placed tile having the same indicia of value and such that no edge of is adjacent to a side having a different indicia of value. Play proceeds until all playable tiles are placed. The value of waste tiles is subtracted from the value of created assets to achieve a score. All players achieve the same score.

9 Claims, 6 Drawing Sheets

FIG. 2

| Bone | Quality | Characteristics | Application |
|---|---|---|---|
| 0 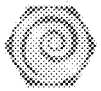 | Pure Spirit | Undifferentiated Essence, All/Nothing, Primal Energy, LARGER SELF | Present, Presence, Consciousness, Vision, Integration, Possibility |
| 1 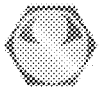 | The "I" | Individuality, Uniqueness, Soul Print, Ego, smaller self, View Point | Self Awareness, Personal Stance, Values, Individual Operating System, Point of View |
| 2 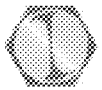 | Other | Relationship, Balance, Opposition, Connectivity, Union, The Dance, The Mirror | Understanding, Partnership, Collaboration, Sympathy, |
| 3 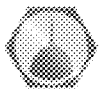 | We | Birth, Creation, Incubation, The Gift, Inspiration, Insight, Karma | Passage, Growth, Yielding, Openness, Creativity, Revealing, Bringing forth |
| 4 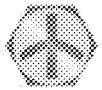 | Structure | Circulation, Rhythms, Movement, Protection, Seasons, Formation, Love, Alignment, Home | Practice, Strategies, Decisions, Design, Development, Flow, Worship, Building, Striving, |
| 5 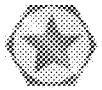 | Works | Manifesting, Energy in Motion, Action, Deeds, | Implementation, Doing, Harvesting, Delivering, Creating |
| 6 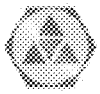 | Community | The Web of Life, Family, Society, The Marketplace, Order, Connectivity, Reciprocity | Responsibility, Belonging, Contribution, Giving, Value, Synergy |
| 7 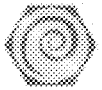 | Spirit Realized | Continuity, Peace, Collective, Nature, Completion, Awareness, Enlightenment, | Transformation, Renewal, Celebration, Unity, Acceptance, Understanding |

| Bone | Assets | -Waste |
|---|---|---|
| 1 | 7 | 1 |
| 2 | 18 | 4 |
| 3 | 21 | 0 |
| 4 | 28 | 0 |
| 5 | 30 | 10 |
| 6 | 48 | 0 |
| 7 | 0 | 0 |
| Sub Total | 152 | -15 |
| X Beats | | X10 |
| Sum | 152 | -150 |
| = COE | +2 | |

FIG. 5

TILE GAME AND METHOD OF GAME PLAY

BACKGROUND OF THE INVENTION

1. Field of the Invention

The present invention relates to games and more particularly to tabletop tile games for entertainment and educational purposes.

2. Description of the Background

Tabletop games include a wide variety of types of games including board games, card games, dice games, tile-based games and other games that are normally played on a table or flat surface. Such games have been played in numerous forms and variations from antiquity and are have been used as a way to teach concepts and strategy to adults and children alike. Board games such as chess, checkers or, more recently, Monopoly® are, as their name suggests, typically played on a marked board or mat that governs some aspect of game play. Other games such as tile games including dominoes and Mahjong require only an unmarked flat. Most tabletop games with the exception of many card games incorporate one or more game pieces which are physical representations that may be manipulated by the player(s) to achieve the goals of the game. Chess pieces, checkers, dice, dominoes and tokens are examples of game pieces used in well known tabletop games.

Domino tiles are flat, rectangular game pieces historically carved from ivory or dark hardwood such as ebony, with contrasting black or white dots referred to as pips. Modern sets may be made from virtually any material and are commonly made of plastic or resin. In their most common form, the tiles, sometimes referred to as bones, are modular rectangles (i.e., composed of two squares joined on a single side) with a number of pips appearing on each half of the tile. The traditional set of dominoes contains one unique piece for each possible combination of the two halves with zero to six spots. This set is referred to as a double-six set because the highest-value piece has six pips on each half (i.e, the "double six"). The pips from one to six are generally arranged as they would be on a six-sided or cubic die and domino tiles are thought to have been originally created or developed as a representation of all of the possible combinations of two such dice. There are 21 possible outcomes of the role of two cubic die. However, because dominoes have grown to include a "zero" tile, there are seven possible faces and thus 28 unique domino tiles in a double-six set.

There are many variations of tile game play generally and even many variations in the games that are played with domino tiles and referred to by the name "dominoes". While these games may teach simple lesions (such as counting for children) and more complex strategy, depending on the rules of the game, traditional dominoes and other tabletop games are characterized by competition between players to "win" the game. Winning may be accomplished by collecting or scoring the most points, by playing pieces to accumulate the least points or by accomplishing a specified goal according to the rules of the game being played. Because of this competition between players, one lesion that is not taught by dominos is that cooperation among players can increase the collective good of the whole. It would be desirable to provide a game that is entertaining, easy to play in virtually any setting, requires few pieces to play and teaches participants to strategize for the good of the whole over the individual winner.

SUMMARY OF THE INVENTION

It is an object of the present invention to provide a game system for the amusement of players.

It is another object of the invention to provide a game system that requires players to strategize within the rules of the game to achieve a maximum result.

It is yet another object of the invention to provide a game that teaches players the value of cooperative and constructive behavior in the creation and sustainable development of a community environment.

These and other objects are achieved by a cooperative tile game played on a planar surface and having bifurcated tiles formed of conjoined hexagonal portions each having an indicia of value. Play is initiated by selecting one or more tiles and placing them on the planar surface in an initial configuration. In a first round the initial configuration is a three tile triangular arrangement and players first exchange tiles from their hand with those in the initial configuration to achieve a predetermined set of tiles in the initial configuration. Subsequent rounds begin with a tile from the previous round. During play tiles are placed on the planar surface by each player in turn such that at least one edge of one of a hexagonal portions is adjacent to an edge of a hexagonal portion of a previously placed tile having the same indicia of value and such that no edge of is adjacent to a side of a hexagonal portion of a previously placed tile having a different indicia of value. Play proceeds until all playable tiles are played, after which the value of waste tiles is subtract from the value of created assets to achieve a score for the round. The score for each round is averaged over the number of rounds played to obtain a score for the game. All players achieve the same score.

In contrast to the vast majority of multi-player games whose object is to beat or shut down the other players, the goals of present game, Cohado™, are to create as many assets for the collective "community" of players, and to eliminate waste. It is believed that if these two principles are applied broadly in life, the functioning of almost every aspect of society will be greatly enhanced.

DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which:

FIG. 2 is diagram of the six glyphs that may appear on the faces of the bones.

FIG. 5 is an exemplary single round scorecard.

DETAILED DESCRIPTION OF THE PREFERRED EMBODIMENT

Figure 1:
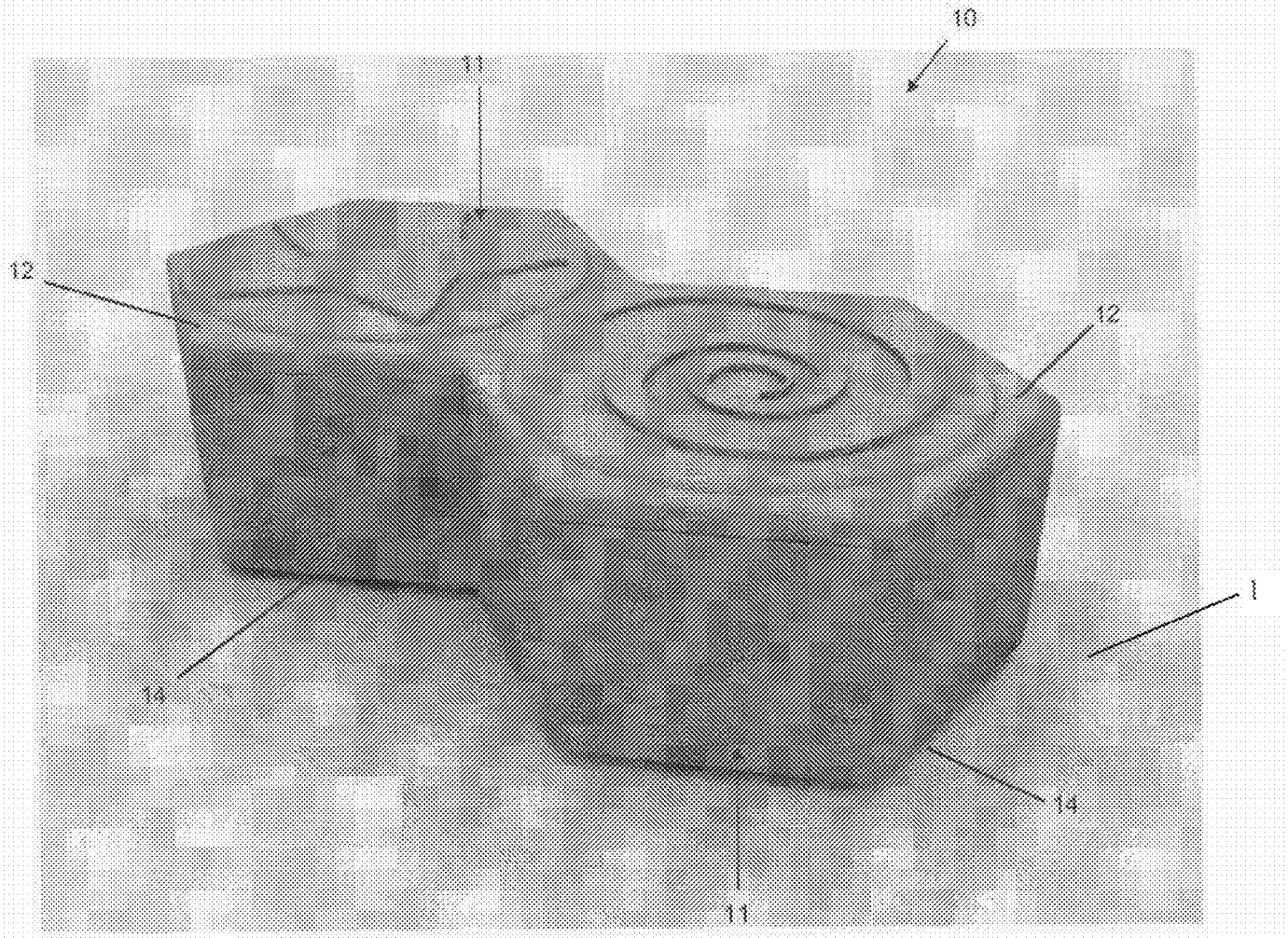
FIG. 1 is a perspective view of an exemplary tile or "bone."

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention that would normally occur to one skilled in the art to which the invention relates.

With reference to FIG, 1, an exemplary tile 10 or "bone" is depicted. As shown, the preferred bone is defined by a pair of three-dimensional conjoined hexagons 11 sharing a single side and having a thickness joining the upper and lower hexagonal surfaces proportional to the side length of the hexagons and sufficient to facilitate easy lifting and placing of the tiles 10 by hand as will be described. Each upper surface 12 of each hexagon is a "face" of the bone such that each hexagon has two faces on which one of the six "glyphs" of the game is displayed. The lower surface 14 of the tiles 10 may preferably be flat for conventional play of a flat surface such as a table. Alternately, lower surface 14 may be concave for cooperative engagement with a playing field or game board having a predefined field of cooperatively sized tessellated regular hexagons having protruding portions 2 to be received within the concavity of the lower surface 14 of the tiles 10 in order to center and retain the tiles in position once placed in the playing field during game play. The tiles 10 are may be formed from any sufficiently hard and strong material and may preferably be formed of metals (such as steel, aluminum or copper), wood, ceramic or plastic materials or combinations thereof The playing field, if present, may be constructed of a foldable wooden, plastic or cardboard surface or may be flexibly constructed of leather or cloth imprinted with the regular hexagonal playing field. The regular hexagonal form of the filed and tile halves is preferred for its tessellating characteristics but other regular tessellating forms (equilateral triangle and square) or irregular tessellating forms may alternately be utilized. In certain embodiments, non-tesselating forms may also be utilized. In an alternate embodiment the planar surface may be comprised of a flat video display panel and the tiles provided in the form of video images depicted on the display.

With reference to FIG. 2, the iconography of the bones is depicted. Each bone bears one glyph on each of its two faces and no two bones are alike. Note that while the symbolism of the 0/7 bones (Pure Spirit/Spirit Realized) varies depending on game play, the glyphs are the same such that there are 6 total glyphs and thus 28 combinations of glyphs on the tiles without repeating a combination. Each glyph is assigned a value or weight as follows: Pure Spirit (0), The "I" (1), Other (2), We (3), Structure (4), Works (5), Community (6), and Spirit Realized (7). As noted, Pure Spirit and Spirit Realized depict the same glyph such that the value assigned to the glyph is determined by game play as will be described. The game is preferably played by five players but a greater or lesser number of players my participate. The game is also played in rounds, also termed generations, with seven being the preferred number of rounds in a game. The object of the game is to use the fewest "beats", or moves, to achieve the minimum amount of waste. Success is not measured by individual loss or gain as in most games. It is scored at a group level so that each member or player contributes to (or detracts from) the success of the whole. Points are accumulated by clustering like faces or glyphs.

Figure 3:
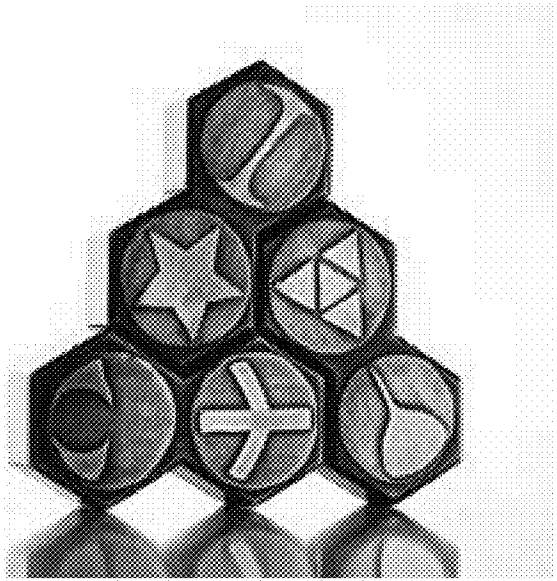
FIG. 3 is a diagram of the Queen Set.

To begin the game, the tiles 10 are randomized either by mixing face-down on the playing surface or by shaking the tiles in an opaque bag or "bonesack." Beginning with the eldest player and advancing heartwise (clockwise), each player takes three tiles from table or bonesack. Each player's drawn tiles are placed face-down on the table in front of the player and are kept out of view of the other players for the duration of the game. Before the first round of the game can begin the players must "evolve" a particular tile configuration, referred to as the "Queen Set," as depicted in FIG. 3. The Queen Set is a triangular tile configuration constructed from the ¼, ⅖, and ⅜ tiles, with the 1, 2, and 3 glyphs at the exterior corners and the 4, 5, and 6 glyphs on the interior. This pattern can only be achieved by using the three specific tiles identified above.

To begin play, after the players draw their tiles, the eldest player at the table draws three of the remaining tiles and places them face down in the inverted triangular configuration of the Queen Set as depicted in FIG. 3. This configuration is called the Tumbler. The elder then inverts the Tumbler revealing the faces of the selected bones. It is highly unlikely that the Tumbler will include all three tiles needed to create the Queen Set.

The first task of the players is to "evolve" the Tumbler into the Queen Set by trading their pieces with the pieces of the Tumbler to create the precise pattern of the Queen Set. Again, the eldest player at the table begins the process and play progresses heartwise. Each player examines their drawn tiles to determine if any of their tiles are one of the three pieces that form the Queen Set. If so, the player trades that piece for one in the Tumbler so as to evolve the Tumbler toward the Queen Set. If they have none of the needed tiles, the player may examine their drawn tiles to determine how best to play their draw to support the goals of the game. The player can then elect to pass or to replace another bone in the Tumbler if they assess that would be the best move. In either case, the table receives one beat (as will be explained below) for trading or passing. If the Queen Set is not achieved on the first cycle through the players, ply continues in turn but players may, on their turn, then draw a single bone from the "well" (the remaining bones not yet distributed to players) and trade it into the Tumbler, or pass if it does not add to the goals of the game at this point. This process continues until the Tumbler is evolved into the Queen Set, after which regular play can begin.

The goal of play is to cluster three or more faces having the same value or weight (i.e., glyph) to accumulate assets for the table while leaving as few hanging tiles as possible. Hanging tiles are tile faces that have not been touched by another face of the same weight. Assets reflect constructively played tiles and consist of clusters of 3 or more adjacent, like glyphs), whereas waste is created when tiles are played in such a way that at least one of the face is left hanging. These are non-constructively played tiles in as much as they are considered waste and detract from the accumulated assets of the table. Bones that remaining at the end of a round that cannot be played are also considered waste. Clusters of only two like faces are neutral, neither adding to assets or waste.

Figure 4A:
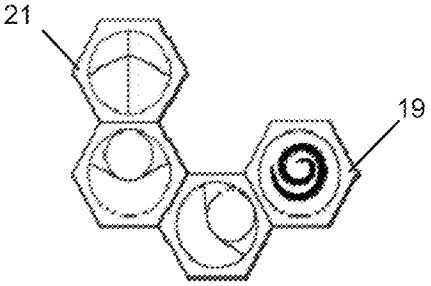
FIGS. 4A through 4D are diagrammatic of legal moves.
Figure 4B:
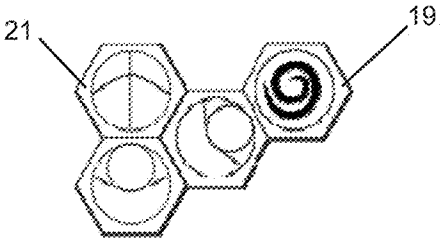
Figure 4C:
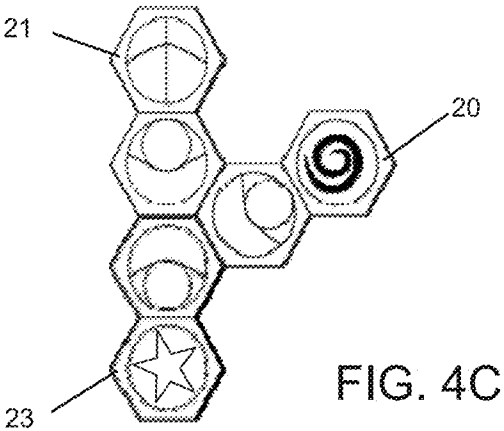
Figure 4D:
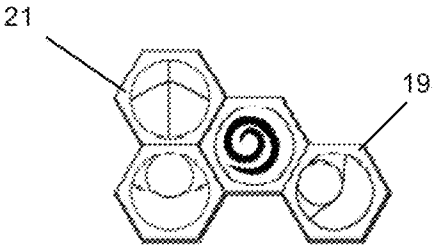

Regular play continues in the order established when evolving the Tumbler and each player takes a turn placing a tile from his or her drawn tiles onto the playing field. With a few exceptions as will being identified, a legal move is a move in which a placed tile is touching edge-to-edge with an already placed tile of the same weight and nothing else. More specifically, with reference to FIG. 4A, a legal move is depicted because the 1 glyph of the placed tile 19 is directly adjacent to the 1 glyph of the previously placed tile 21 but does not share a side with the 4 glyph. FIG. 4B depicts a prohibited or illegal move in that although the 1 glyph of the placed tile 19 is directly adjacent to the 1 glyph of the previously placed tile 21, it shares a side with the 4 glyph of the previously placed tile 21 in violation of the ruled of game play. As with FIG. 4A, FIG. 4C also depicts a legal move because the 1 glyph of the placed tile 20 is directly adjacent to the 1 glyph of the two previously placed tiles 21, 23 but does not share a side with the 4 glyph of tile 21 or the 5 glyph of tile 23. FIG. 4D may or may not be a legal move depending on game play as will be described.

Play continues in a round-robin fashion. If a player cannot make a legal move with the pieces in her/his hand, the player must pass, and the table collects a beat. If a player passes his or her turn without placing a tile onto the playing field, an extra beat is assessed to the table. A beat is any move in the game and represents an opportunity to create an asset or waste by placing a tile. Extra beats are plays that do not add a bone to the table, in other words, plays or passes that can not be counted by counting the bones on the field of play. If a turn passes without a tile being placed then an extra beat is assessed to account for the lost opportunity. Extra beats are also assessed for unearned placements that begin each round (such as for the three bones of the Tumbler) and for trading of tiles between a player's hand and those on the table which is permitted. Extra beats may also be assessed for steps necessary to correct an illegal move as they are otherwise unaccounted for. Extra beats are counted with beads or stones provided with the game, and are used to calculate the scoring of each round as will be described.

Every Spirit glyph has a value of 0 or 7 depending upon when it is played. The first and last Spirit glyphs of a round are played "Wild and Free" and have a weight of 0. All other spirits played have a weight of 7. A "wild" Spirit glyph means that the glyph can represent any other glyph and can be played anywhere. Wild Spirit glyphs remain wild for the entire round, which is to say that they take on the identity of the glyph that they are placed next to, can be adjacent to any other glyph or glyphs. With reference to FIG. 4D, if the Spirit glyph of the placed tile 19 were the first or last Sprit glyph of a given round, then the depicted placement would be a legal move because the glyph would be a 0, or wild. If the placement were not the first or last Spirit glyph played, the move would be illegal as the glyph would be a 7. Additionally, if the last spirit is played remains open for the duration of the round, i.e., is not locked from being played off of, and remains playable, all hanging spirits become wild and take on a value of 0 and therefore count as zero waste. If the last spirit bone is locked at the end of the round, i.e., played in such a way that it can not be played off of by another piece, all hanging spirits take on a value of 7 and are counted as waste. The reason for the last spirit rule is that the goal of each generation is to leave as little waste for the next generation to deal with.

Play continues until all playable bones have been played. This may occur when all bones have been played or when all un-played bones are "locked out." A locked bone on the playing field is a bone off of which no legal move can be played (except the first or last Spirit glyph). A face of a bone in a player's hand is "locked out" if all similar faces already placed on the playing field are locked. A bone in a player's hand is "locked out" if both faces are locked out. Locking faces is one way of creating waste. At the end of each round the "coefficient", or "Coe", is calculated, and the score logged (as will be described).

Subsequent rounds begin with the heaviest hanging or wasted bone being left on the table. All remaining bones are placed into the bonesack or well and mixed again. The person playing the last bone in the preceding round begins play for the next round off of this bone after drawing three bones from the table or bonesack or well. If there were no hanging bones, the elder draws from the bonesack or well after everyone has drawn their hand. This will seed the next round of play. The final player from the last round will then commence play. Placement of the Tumbler and evolution of the Queen Set is only required at the start of the first round and is not repeated in subsequent rounds.

Figure 6A:
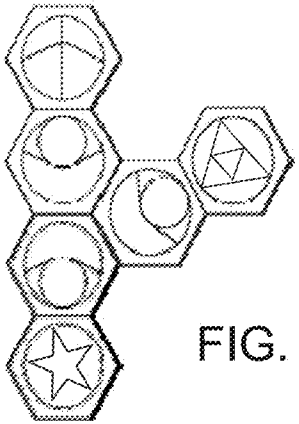
FIGS. 6A through 6D are diagrammatic of scoring clusters.
Figure 6B:
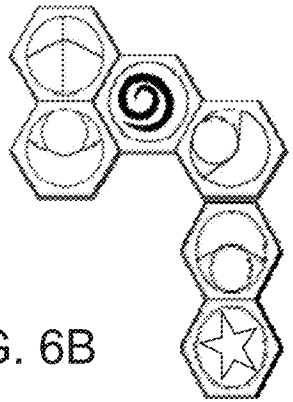
Figure 6C:
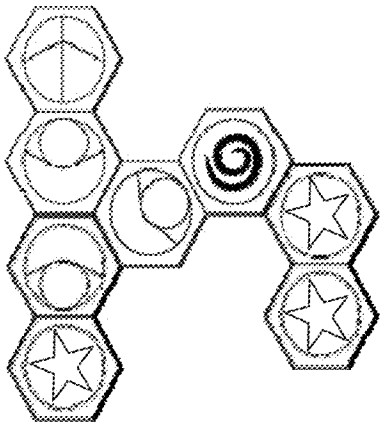

With reference to FIG. 5, scoring for a round is calculating the value of assets generated (A) and subtracting the waste (W), multiplied by the number of beats. Assets are any cluster of three or more adjacent faces having the same glyph and the value of the asset is the weight of the glyph times the number of faces in the cluster. For example, an asset comprising a cluster of three 1 glyphs as depicted in FIG. 6A has a total asset value of 3. A pair of adjacent faces having the same glyph, as seen in FIG. 4A, is not calculated as an asset and has no positive value, but is also not waste and thus has no negative value. However, a wild Spirit glyph adjacent to a pair of like-glyphed faces, as in FIG. 4D will serve to convert the pair into an asset and may link to another like-faced glyph that would otherwise not be adjacent or contiguous, as in FIG. 6B. A wild Spirit glyph may be counted as part of any asset to which it is adjacent and can be counted as part of more than one asset simultaneously. Thus, for example, the cluster of 1 glyphs as depicted in FIG. 6C counts the 0 glyph among it (presuming it was played as wild) and thus has a value of 4. Simultaneously, again presuming it were played as wild, the Spirit glyph would also be counted as part of the cluster of three 5 glyphs, transforming it from a neutral-value cluster of two, to an asset value of 15.

Figure 6D:
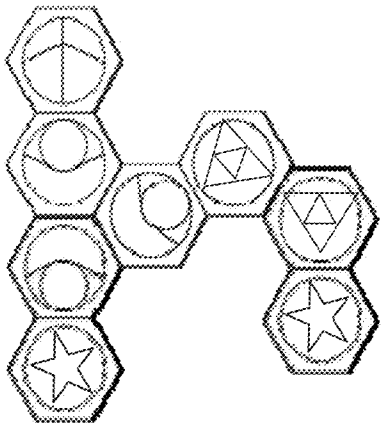

After assets have been tallied, the waste is calculated by first identifying all hanging bones. A hanging bone is any face that had not been legally played against on at least one side. For example, both 5 glyphs and the 4 glyph of FIG. 6D are hanging while the 6 glyphs, though not an asset, are not hanging and are thus neutral. Note that any un-played face in the Queen Set of the first round (usually the 4, 5, or 6) are considered to be hanging bones unless touched by a 0, or Spirit Bone. The total weight of the hanging bones is multiplied by the number of extra beats to reach the total weight of the waste, as depicted in the exemplary single-round score card of FIG. 5. The waste is subtracted from the generated assets to reach the coefficient or score for the round. A positive coefficient indicates that the player group left the universe better than it found it. A negative number indicates that the player group sacrificed the next generation for the current. A coefficient is tallied for each round played, and the coefficients for each round are averaged together to obtain a coefficient for the game as a whole. This coefficient will be averaged into each player's overall average Coe, much as a baseball player's batting average for each game is averaged into his/her overall batting average.

Thus, the formulas for calculating the score or COE at the end of each round is as follows:

$$-W+A=COE$$

In which W is the total waste which will always be a negative number and A is the total generated assets as described above. Waste is determined by the following equation:

$$-H\times B=-W$$

In which H is the number of hanging bones, B is the number of extra beats including at least the 3 extra beats for the first round and 1 extra beat for each subsequent round as described above. Once the full 7 generation/round game is completed, the COE score of each generation or round are added together and divided by 7 to get the average COE of the game. If fewer than 7 rounds are played, the COE is calculated by dividing the total sum of the rounds by the number of rounds played.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood; therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. A multi-player game, comprising a planar surface; and a plurality of bifurcated tiles, each of said tiles comprising a first hexagonally shaped portion permanently conjoined on a single side to a second hexagonally shaped portion, each of said first and second hexagonally shaped portions having five free sides extending from said conjoined side to form a regular hexagon each defining an upper surface on which one of a predetermined indicia of value is depicted;

wherein said plurality of bifurcated tiles are positionable on said planar surface in accordance with a rule of said game whereby at least one free sides of a hexagonal portion of each of said plurality of bifurcated tiles is adjacent to one or more free sides of one or more hexagonally shaped portions of previously positioned tiles having the same indicia of value, and no free side of a hexagonal portion of each of said plurality of bifurcated tiles is adjacent to a free side of a hexagonal portion of a previously positioned tile having a different indicia of value;

wherein each of said plurality of bifurcated tiles comprises a recess on a lower surface thereof, said lower surface being opposite said upper surface; and wherein said planar surface further comprises a plurality of raised protuberances, each of said plurality of protuberances corresponding to one of said recesses on said lower surface of each of said plurality of bifurcated tiles.

2. The multi player game of claim 1 wherein said planar surface is undivided.

3. The multi-player game of claim 1 wherein said planar surface is divided into a plurality of hexagonal playing positions.

4. The multi-player game of claim 1 wherein said predetermined indicia of value consist of seven indicia each having a different value.

5. The multi-player game of claim 1 wherein all players of said multi-player game achieve the same score.

6. The multi-player game of claim 5 wherein said score is calculated by subtracting a value of waste created by the positioning of said bifurcated tiles relative to one another on said planar surface from a value of assets created by the positioning of said bifurcated tiles relative to one another on said planar surface.

7. The multi-player game of claim 6 wherein said value of assets is the sum of the value of each cluster of three or more hexagonally shaped portions depicting the same indicia of value and sharing with at least one other hexagonally shaped portion of said cluster at least one free side, and wherein the value of each cluster is the product of the number of hexagonally shaped portions in said cluster multiplied by the value of the depicted indicia.

8. The multi-player game of claim 7 wherein said value of waste is the sum of the value of said indicia of each hexagonally shaped portion of a bifurcated tile on said planar surface adjacent to which no other bifurcated tile has been positioned.

9. The multi-player game of claim 1, wherein each of said plurality of bifurcated tiles has a thickness, said thickness being equal to the length of each of said five free sides of said bifurcated tiles.

* * * * *